United States Patent [19]

Kamin

[11] 4,261,327

[45] Apr. 14, 1981

[54] RANGE GRATE AND CLIP

[75] Inventor: George W. Kamin, Arcadia, Calif.

[73] Assignee: Magic Chef, Inc., Cleveland, Tenn.

[21] Appl. No.: 27,827

[22] Filed: Apr. 6, 1979

[51] Int. Cl.[3] ..... F24C 15/10; F24H 13/00

[52] U.S. Cl. ..... 126/215; 126/211; 126/152 R

[58] Field of Search ..... 126/1 R, 1 A, 1 AA, 126/152 R, 152 B, 152 P, 153, 215, 214 A, 214 C, 211

[56] References Cited

U.S. PATENT DOCUMENTS

| | | | |
|---|---|---|---|
| 2,440,035 | 4/1948 | Williams et al. | 126/214 C |
| 3,170,457 | 2/1965 | Bucellato | 126/214 C |
| 3,263,676 | 8/1966 | Kamin | 126/215 |
| 3,416,513 | 12/1968 | Fischer et al. | 126/215 |

*Primary Examiner*—Samuel Scott
*Assistant Examiner*—Wesley S. Ratliff, Jr.
*Attorney, Agent, or Firm*—Bacon & Thomas

[57] ABSTRACT

A range has a grate overlying a burner, the grate having radial arms provided with downwardly extending projections near their ends and those projections are releasably held by spring clips mounted in openings in the range top. The spring clips thus hold the grate in place and prevent rattling when the range is used in a trailer or other vehicle.

1 Claim, 3 Drawing Figures

RANGE GRATE AND CLIP

BACKGROUND OF THE INVENTION

This invention relates particularly to a grate for a range burner and a clip for holding the grate in place against rattling or inadvertent removal. Applicant's prior U.S. Pat. No. 3,263,676, discloses and claims a clip for holding a grate to a range top, but as will be seen the grate and clip of the prior patent is considerably different from the present grate and clip.

SUMMARY OF THE INVENTION

In general, the invention comprises a range top having a grate overlying a burner, which grate is stamped from sheet metal and is provided with radial arms of generally U-shaped downwardly open channel form. The ends of the arms rest on the range top and are provided with downwardly extending projections entering further openings in the range top to hold the grate in place over the burner. The patent to Williams, U.S. Pat. No. 2,440,035, shows a range grate of generally the same construction as described above and with projections entering openings in the range top to hold the grate centered over the burner. However, the present invention further includes a spring clip device in each of the further openings which clip resiliently engages the projections extending downwardly from the grate arms and releasably holds the grate in place against inadvertent removal and holds the same against rattling when the range is used in a trailer or similar vehicle.

DESCRIPTION OF A PREFERRED EMBODIMENT

Figure 1:
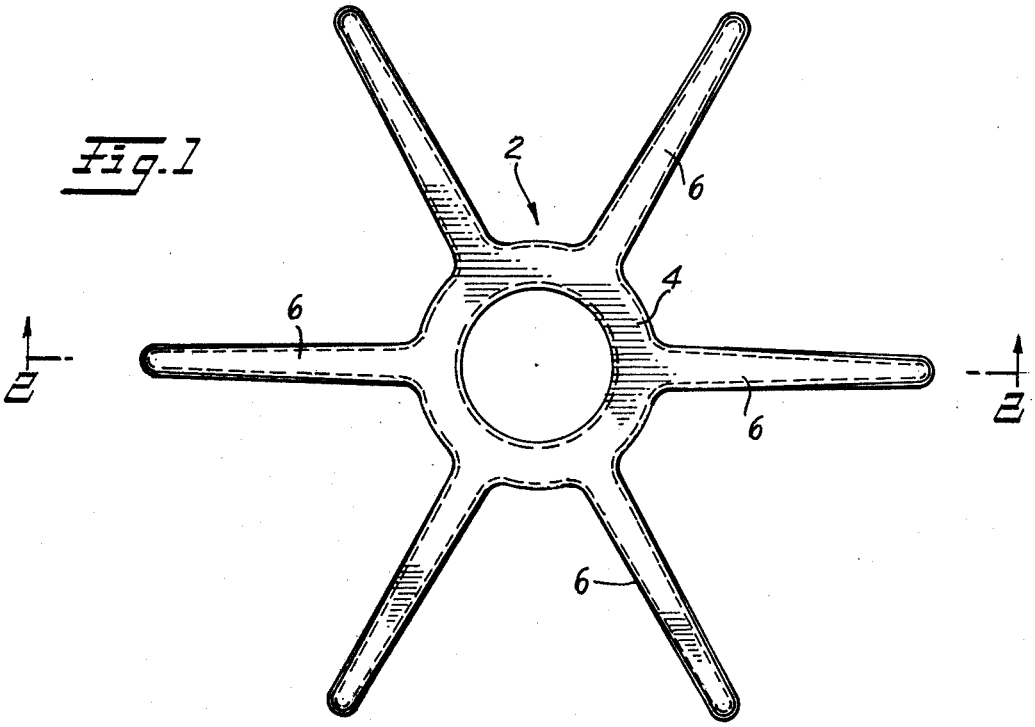
FIG. 1 is a plan view of a range grate embodying the present invention.
Figure 2:
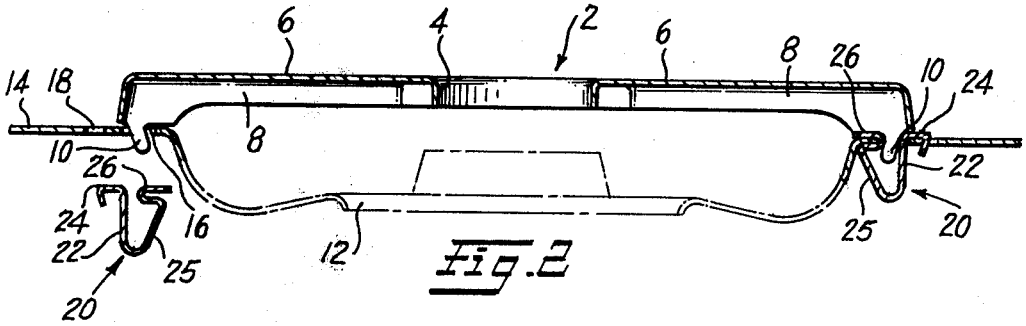
FIG. 2 is a vertical section view taken along the line 2—2 of FIG. 1 and further showing portions of the range and the spring clip of the present invention.
Figure 3:
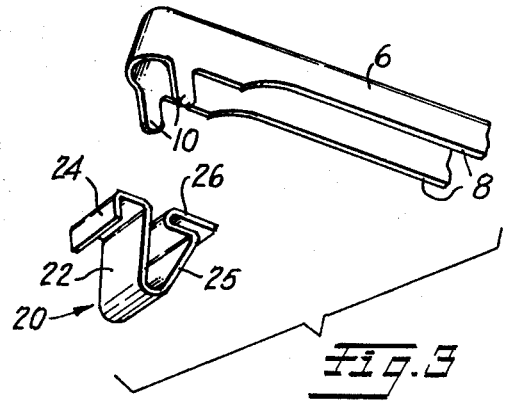
FIG. 3 is an exploded view of a fragmentary portion of one of the grate arms and the spring clip.

As seen in FIG. 1, the grate generally designated by numeral 2 is formed with a circular central portion 4 and radial arms 6. The entire grate is preferably formed of sheet metal and stamped to define the arms by downwardly open channels as illustrated in FIG. 2. The sides of the channels defining the arms 6 are in the form of flanges 8 and adjacent the ends of the arms 6 are downwardly extending projections 10 integral with the flanges 8. As shown, those projections 10 are slanted inwardly generally toward the center of the burner opening 12. Numeral 14 designates a portion of a range top having the burner opening 12 therein in the bottom of a dished portion that is spanned and covered by the grate 2. Outwardly of the dished portion, the range top is provided with further openings 16 at portions corresponding to the positions of the ends of arms 6 and through which openings the projections 10 extend when the grate is in place. Each of the openings 16 is large enough to loosely receive the projections 10. Radially outwardly of each opening 16 are third openings 18. In each of the openings 16, there is placed a spring clip device 20 to resiliently engage and hold the projection 10.

As best shown in FIG. 2, the spring clip 20 is of generally U-shape with upwardly extending legs. One of the legs 22 is configured at its ends to define a downwardly open hook 24, the end of which will extend into the opening 18 as best shown at the right hand side of FIG. 2. The inner leg 25 of the clip is formed at its upper end to define a horizontally open hook portion 26 which, when the clip is placed in the opening 16, slidably embraces the inner edge of the range top adjacent the opening 16, as also clearly shown at the right hand side of FIG. 2. The clip 20 is formed of spring material and is so configured that in its normal configuration and when placed in the opening 16, the bight portion of the hook 26 is spaced from the edge of the opening 16 so that the legs of the clip can be spread apart somewhat. As previously stated, the projections 10 are slanted inwardly and when placed in the openings 16 having the clip 20 therein, the inner edges of the projections 10 function to cam the hook portion 26 away from the hook portion 24 to thus enlarge the space between those portions and permit the projection 10 to be thrust downwardly between the legs of the clip. Since the legs 10 are slanted inwardly, their inner edges define slanted surfaces that are then resiliently engaged by the rounded portion of the hooks 26 to urge the legs 6 downwardly into snug engagement with the range top, to hold the projections 10 releasably in the openings 16 and also prevent rattling of the grate when the device is used in a range on a trailer or similar recreational vehicle. The grate may thus be readily removed for cleaning or for other purposes by simply pulling the same upwardly.

While a single specific embodiment of the invention has been shown and described herein, the same is merely illustrative of the principals involved and other forms may be resorted to within the scope of the appended claims.

I claim:

1. In a range having a top provided with a burner opening therein:

a grate overlying said burner opening and having radial arms engaging said range top, said arms having downwardly extending projections adjacent their ends and extending through further openings in said range top;

resilient means in at least one of said further openings engaging said projections and releasably securing said grate in place on said range top;

said resilient means comprising a separate spring clip of generally U-shape with the ends of said clip being of hook shape and engaging opposite edges of said further opening;

said hook shaped ends being normally spaced apart a distance less than the corresponding dimensions of said projection and being resiliently movable away from each other to resiliently receive and grip one of said projections, one end of said clip defining a downwardly open hook, the end of which extends into a third opening in said range top, at one side of said further opening, the other end of said clip defining a horizontally open hook slidably embracing said range top at the other side of said further opening.

* * * * *